US011873689B2

(12) United States Patent
Tian et al.

(10) Patent No.: US 11,873,689 B2
(45) Date of Patent: Jan. 16, 2024

(54) INTEGRATED PILING TOOL WITH CONTINUOUS DRILLING AND CIRCULATION POURING

(71) Applicant: Southwest Petroleum University

(72) Inventors: Jialin Tian, Chengdu (CN); Lei Tang, Chengdu (CN); Yan Li, Chengdu (CN); Chunyu Xing, Chengdu (CN)

(73) Assignee: Southwest Petroleum University, Chengdu (CN)

( * ) Notice: Subject to any disclaimer, the term of this patent is extended or adjusted under 35 U.S.C. 154(b) by 521 days.

(21) Appl. No.: 17/187,162

(22) Filed: Feb. 26, 2021

(65) Prior Publication Data

US 2022/0162919 A1 May 26, 2022

(30) Foreign Application Priority Data

Nov. 26, 2020 (CN) ..... 202011356617.9

(51) Int. Cl.
*E21B 17/22* (2006.01)
*E21B 10/44* (2006.01)
(Continued)

(52) U.S. Cl.
CPC ..... *E21B 17/22* (2013.01); *E02D 5/34* (2013.01); *E21B 10/43* (2013.01); *E21B 10/44* (2013.01); *E21B 10/60* (2013.01); *E02D 5/46* (2013.01)

(58) Field of Classification Search
CPC ..... E21B 7/005; E21B 17/22; E21B 10/44; E21B 7/201
See application file for complete search history.

(56) References Cited

U.S. PATENT DOCUMENTS 2,306,118 A * 12/1942 Graham ..... E21B 7/201 175/324
2,741,462 A * 4/1956 Baca ..... E21C 25/58 175/404

(Continued)

FOREIGN PATENT DOCUMENTS

CN 103244051 A 8/2013
CN 111622676 A 9/2020

OTHER PUBLICATIONS

Office Action dated May 31, 2021; Chinese Patent Application No. 202011356617.9; 4 pgs.; The State Intellectual Property Office of the P.R.C., People's Republic of China.

*Primary Examiner* — Blake Michener
(74) *Attorney, Agent, or Firm* — Andrew D. Fortney; Central California IP Group, P.C.

(57) ABSTRACT

An integrated piling tool with continuous drilling and circulation pouring includes a power connector, a circulation device, a drill assembly, a bottom clearing and a pouring mechanism. The circulation device includes a circulating drill barrel and a spiral piece, and it achieves cuttings removal continuously; the two ends of the circulating drill barrel are connected with the power connector and the drill assembly, respectively. The drill assembly includes a drill body, a connecting sleeve B, transmission parts, a drill tool holder and drilling teeth, and the drill assembly accomplish rock breaking and rotary excavation. The clearing mechanism includes a linkage and clearing blades to remove cuttings at bottom hole. The pouring mechanism includes pouring channels and control parts to achieve continuous concrete pouring. The invention provides a new integrated piling tool with continuous drilling and circulation pouring, which improves the efficiency of piling, circulation and pouring.

9 Claims, 4 Drawing Sheets

A-A

(51) Int. Cl.

| | |
|---|---|
| ***E02D 5/34*** | (2006.01) |
| ***E21B 10/43*** | (2006.01) |
| ***E21B 10/60*** | (2006.01) |
| *E02D 5/46* | (2006.01) |

(56) References Cited

U.S. PATENT DOCUMENTS

| | | | | | |
|---|---|---|---|---|---|
| 3,206,936 | A * | 9/1965 | Moor | E21B 10/44 | 285/913 |
| 3,508,622 | A * | 4/1970 | Sturgeon | E21B 10/44 | 175/384 |
| 3,512,366 | A * | 5/1970 | Turzillo | E02D 5/30 | 405/242 |
| 3,529,428 | A * | 9/1970 | Batten | E21B 10/44 | 175/232 |
| 3,962,879 | A * | 6/1976 | Turzillo | E21B 10/44 | 405/257 |
| 6,283,231 | B1 * | 9/2001 | Coelus | E02D 5/36 | 175/391 |
| 2010/0263929 | A1 * | 10/2010 | Ditillo | E02D 5/36 | 175/19 |
| 2019/0032412 | A1 * | 1/2019 | Banjo | E21B 7/008 | |

* cited by examiner

A-A

INTEGRATED PILING TOOL WITH CONTINUOUS DRILLING AND CIRCULATION POURING

TECHNICAL FIELD

The present invention belongs to the field of construction engineering and mechanical engineering, and relates to an integrated piling tool with continuous drilling and circulation pouring.

BACKGROUND OF THE INVENTION

In the process of building infrastructure piling, due to the complexity and unpredictability of geological structure in different areas, the performance requirements of piling tools may be inconsistent with and lag behind the conditions in pile wells, resulting in low efficiency in drilling, cuttings discharge and pouring. The performance of such piling tools can't meet the requirements of efficient piling, because the structural design of the drill assembly of the pile driver fails to comprehensively consider geological factors such as sand soil, clay soil, silty soil and rock interlayer. The three processes of the cuttings removal circulation are successively carried out such as stopping drilling, lifting the drill pipe and dumping cuttings, while in the case of deep pile wells, the cuttings removal circulation mode of alternately drilling and cuttings removal takes up too much time, and the pouring process needs to improve the piling equipment and replace other special pouring tools after the piling is completed, so as to accomplish continuous pouring of concrete. It causes intermittent phenomenon among drilling construction, cuttings discharge and circulation pouring operation in the hard layer. It needs to spend more time, finances, material and manpower because of the existence of intermittent drilling.

Therefore, how to achieve efficient drilling synchronous circulation and continuous pouring are the technical problems that this field is eager to solve.

SUMMARY OF THE INVENTION

The purpose of the invention is to provide a pure mechanical control, higher efficiency and more reliable continuous drilling and circulation pouring integrated piling tool for building and high-speed rail infrastructure.

In order to achieve the purpose of the invention, the technical scheme adopted by the invention is as follows: the integrated piling tool with continuous drilling and circulation pouring includes a power connector, a circulation device, a drill assembly, a cleaning mechanism and a pouring mechanism. The circulation device includes a connecting sleeve A, a drill barrel, a spiral piece, a spiral reinforcement, a circulation connection, a semicircle connecting groove A and a fixing orifice. Head and tail ends of the circulation device are connected to the power connector and drill assembly, respectively, which can accomplish multiple drill barrels, fore and aft, connected in turn. In the process of piling drilling, the cuttings are continuously transported to the ground by the spiral piece and transmission parts, successively. The drill assembly comprises a drill body, a connecting sleeve B, the transmission parts, a drilling tool holder, drilling teeth, fixing pieces A, and a semicircle connecting groove B. The drilling teeth are detachable from the drilling tool holder and are configured to cut and burst rock, and the transmission parts deliver cuttings from inside out and from bottom up to the spiral piece. The pouring mechanism comprises a pouring channel, a pin and a valve. The concrete pushes the valve through the pouring channel, which may comprise the circulation device and the drill assembly, to implement the pouring.

Preferably, the connection sleeve A is at an upper end of the circulation device and is adapted to the shape and size of a polygonal connection of the power connector, the semicircle groove and the fixing orifice form a circular fixing hole, and the circulation device is fixed to the power connector with a fixing pin B; the circulation connection is at a lower end of the circulation device and is suitable for the shape and size of the connecting sleeve B; the semicircle connecting groove A and the semicircle connecting groove B form another circular fixing hole the circulation device is fixed to the drill assembly by the fixing pin C; and the spiral reinforcement is inside the circulation device, which is connected with the drill barrel.

Preferably, the drill tool holder includes a circular outer ring, an inner ring that is coaxial with the outer ring, a blade between the inner ring and the outer ring, and a groove near the inner ring. The drilling teeth are on the end face of the bottom of the drill tool holder, and the drill tool holder is connected with the drill body.

Preferably, an angle $\alpha$ between the axis of the drilling teeth and the horizontal plane of the drill tool holder is between 60° and 85°.

Preferably, the transmission parts include a first transmission spiral blade, a second spiral transmission blade and a third spiral transmission blade. The number of the blades in the transmission parts is not limited to three. The spiral transmission blades are uniformly arranged on the plane of the drill tool holder. The spiral transmission parts have a taper.

Preferably, the pouring channel successively includes an inner channel A of the power connector, an inner channel B of the drill barrel, and an inner channel C of the drill body.

Preferably, the valve has a circumference with an axial convex platform that matches with the groove of the drill tool holder, and the valve is hinged to the fixing pieces A of the drill assembly by the pin. The detachable drilling teeth are close to a bottom surface of the well.

Preferably, the power connector comprises a polygonal sleeve, a semicircular fixing hole, a polygonal connection, and a semicircle groove. The polygonal sleeve is matched with the clearance of a power input shaft; the semicircular fixing hole is symmetrical around the polygonal sleeve. The semicircular fixing hole and a semicircle groove A form a circular hole, and the power connector and the power input shaft are fixed in the axial direction by a fixing pin A that matches with the circular hole. The polygonal connection is connected to the connecting sleeve A of the circulation device.

Preferably, the cleaning mechanism includes a cleaning blade, a linkage, control parts and fixing pieces B; which is connected with the fixing pieces B by a fixing pin and the end of the linkage, and the (external) control parts are configured to extend the cleaning blade.

Compared with the existing technology, the present invention has the following beneficial effects: the present invention provides a new piling tool with high-efficiency drilling, synchronous circulation cuttings discharge and continuous pouring. The drilling efficiency in piling is improved because of the structural design of the drill parts. The circulator structure is designed so that the cuttings discharge is synchronized with the drilling process. After the piling is completed, the existing piling tools are used to pour the concrete efficiently. This setting method is simple in structure and completely depends on mechanical structures, without the need for electrical structures that are prone to failure in the complex and changeable underground environment. It can achieve higher efficiency, more reliable circulation and simple operation.

Figure 1:
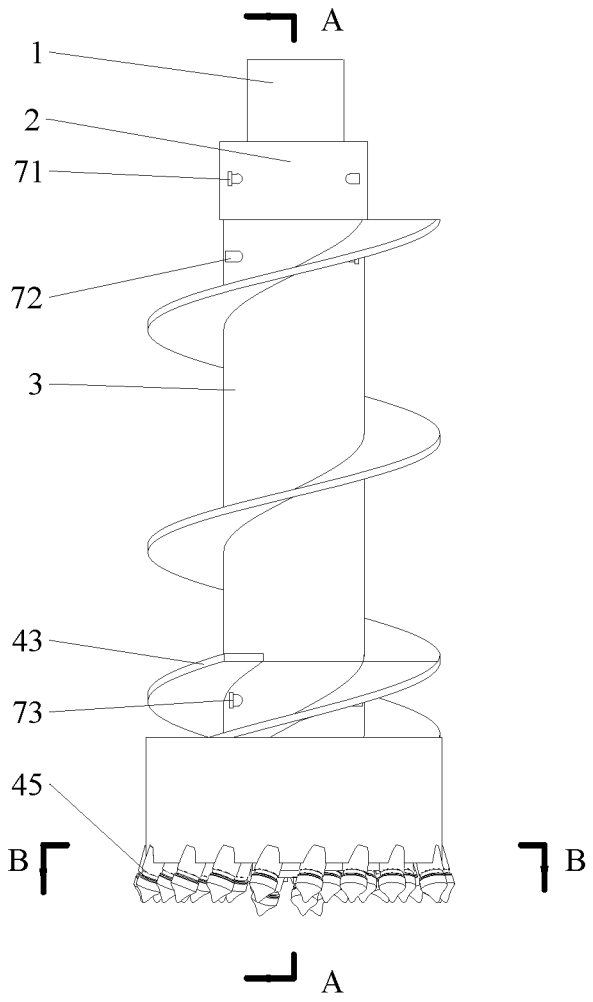
FIG. 1 is an elevation view of the present invention.

In the Figures: 1—power input shaft, 11—semicircle groove A, 2—power connector, 21—Polygonal sleeve, 22—semicircular fixing hole, 23—polygonal connection, 24—semicircle groove, 3—circulation device, 31—connecting sleeve A, 32—drill barrel, 33—spiral piece, 331—spiral A, 332—spiral B, 333—spiral C, 34—spiral reinforcement, 35—circulation connection, 36—semicircle connecting groove A, 37—fixing orifice, 41—drill body, 42—connecting sleeve B, 43—transmission parts, 431—the first transmission spiral blade, 432—the second transmission spiral blade, 433—the third transmission spiral blade, 44—drill tool holder, 441—outer ring, 442—inner ring, 443—blade, 444—grooves, 45—drilling teeth, 46—fixing pieces A, 47—semicircle connecting groove B, 51—cleaning blade, 52—linkage, 53—control parts, 54—fixing pieces B, 61—pouring channel, 611—inner channel A, 612—inner channel B, 613—inner channel C, 62—pin, 63—valve, 631—axial convex platform, 632—radial convex platform A, 633—radial convex platform B, 71—fixing pin A, 72—fixing pin B, 73—fixing pin C, 74—fixing pin.

DETAILED DESCRIPTION OF THE INVENTION

As illustrated in FIGS. 1-5, the integrated piling tool with continuous drilling and circulation pouring includes a power connector 2, a circulation device 3, a drill assembly, a cleaning mechanism and a pouring mechanism.

The power connector 2 includes a polygonal sleeve 21, a semicircular fixing hole 22, a polygonal connection 23, and a semicircular groove 24. The polygonal sleeve 21 is matched with a clearance of the power input shaft 1. The semicircular fixing hole 22 is arranged symmetrically around the polygonal sleeve 21. The semicircular fixing hole 22 and the semicircular fixing groove 11 of the power input shaft 1 form the circular hole. The power connector 2 and the power input shaft 1 are fixed axially through the fixing pin A 71. The polygon connecting 23 is connected with the connecting sleeve A 31, The circulating device 3 comprises a connecting sleeve A 31, a circulating drilling barrel 32, a spiral piece 33, a spiral reinforcing 34, a circulation connecting 35, a semicircle connecting groove A 36, and a fixing orifice 37. Both ends of the circulating device 3 are connected with the power connector 2 and a bit connecting sleeve B 42, respectively. When the single circulation device 3 can't meet the requirement about pile driving depth, multiple circulation devices 3 can be connected sequentially from end to end to build a longer circulation device to meet the requirement of pile driving.

The drill assembly comprises a drill body 41; a bit connecting sleeve B 42, transmission parts 43, a drill tool holder 44, drilling teeth 45, a fixing piece A 46, and a semicircle connecting groove B 47. The bit tool holder 44 is provided with drilling teeth 45, and the drilling teeth 45 are coaxially connected with a bit tool holder 44 which can be disassembled.

The cleaning mechanism comprises a cleaning blade 51, a linkage 52, control parts 53 and a fixing piece 54. The cleaning blade 51 is hinged with the fixing piece B 54 and the linkage 52. One end of the control parts 53 is connected to the outside, and the other end is connected to the linkage 52 which is movably mounted on the drill body 41. The hinged point of the drill body 41 and the linkage 52 is equivalent to a fulcrum. The extended or contracted control parts 53 are controlled by the external control so that the two ends of the linkage 52 move in opposite directions to push the cleaning blade 51, resulting in the cleaning blade 51 is extended, and there is an angle β between 0 and 90° formed between the cleaning blade 51 and the plane of the drill tool holder 44. At this time, the cleaning blade 51 is working according to the rotation direction during drilling to reduce the cuttings remaining at the bottom of the well.

The pouring mechanism includes a pouring channel 61, a pin 62, and a valve 63. The pouring channel 61 includes the inner channel A 611 of the power connector 2, the inner channel B 612 of the drill barrel 32, and the inner channel C 613 of the drill body 41. The concrete passes through the pouring channel 61 to open the valve 63 and flows to the bottom of the well to accomplish the concrete pouring. If pile driving is deep under complex geological conditions, the design of single circulation device 3 can't meet the requirement about the depth of the pile driving. At this point, multiple circulation devices 3 can be in serial connection to each other. The pouring channel 61 can include multiple inner channels B 612 in series, then connected to the inner channel A 611 and the inner channel C 613 in series.

Figure 2:
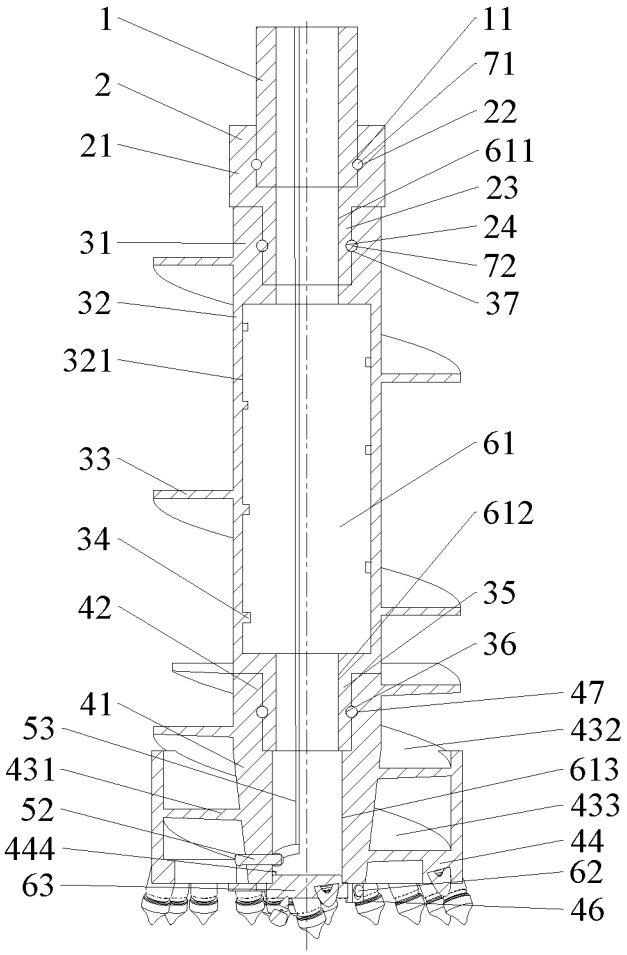
FIG. 2 is cross-sectional view of FIG. 1 of the present invention in an A-A direction.
Figure 3:
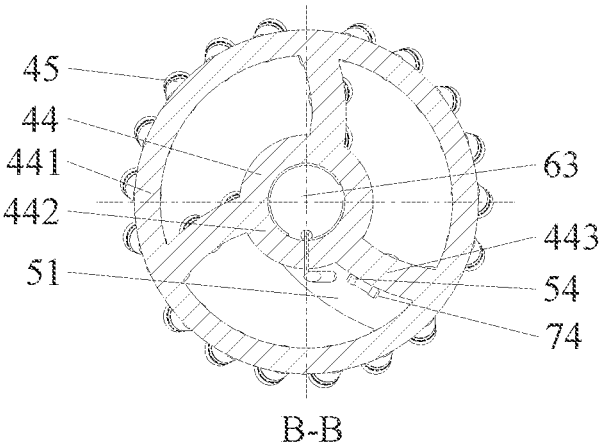
FIG. 3 is cross-sectional view of FIG. 1 of the present invention in a B-B direction.
Figure 4:
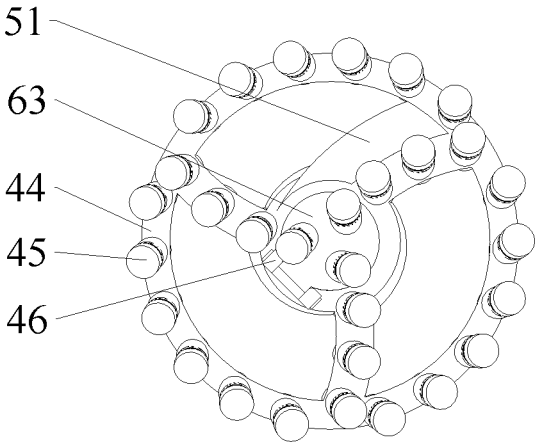
FIG. 4 is the upward view of FIG. 1 in an embodiment.

As shown in FIG. 2, in one embodiment, the upper end of the circulation device 3 is provided with a connecting sleeve A 31 that is suitable for the shape and size of the polygonal connection 23 of the power connector 2, and the lower end of the circulation device 3 is provided with the circulation connection 35 that is suitable for the shape and size of the connecting sleeve B 42. The circulation connection 35 is set on the semicircle groove 24. Namely, the ends of power connector 2 connect to the polygonal connection 23 and the connecting sleeve A 31, respectively, a circular fixing hole is formed between the semicircle groove 24 and the fixing orifice 37, and the circulation device 3 connects with the power connector 2 through the fixing pin B 72 to implement the circumferential and axial fixation.

The inside of the circular drill barrel 32 is uniformly arranged with the spiral reinforcement 34, which has the same pitch as the spiral piece 33. It is not limited to use a single spiral reinforcement 34 for coaxial connection with the inside or outside of the circular drill barrel 32. In this setting mode, the drilling process is light in weight and high in structural strength, which can meet the requirement that the drilling throughput per unit time is greater than the circulating cuttings discharge amount. The cuttings are continuously transported to the ground through the spiral piece 33 to achieve the purpose of efficient cuttings discharge.

As shown in FIG. 2, in one embodiment, the drill assembly includes a drill body 41, a connecting sleeve B 42, transmission parts 43, a drill tool holder 44, drilling teeth 45, a fixing piece 46 and a semicircle connecting groove B 47. The detachable drilling teeth 45 are arranged on the drill tool holder 44.

The drill assembly is provided with a connecting sleeve B 42 that is suitable for the shape and size of the circulation connection 35 and the polygonal connection 23 to achieve the connection between the circulation device 3 and the drill assembly. It can take the same measures to connect the power connector 2 and the connecting sleeve B 42 to implement the transmission of bit-on-bit pressure and torque.

Figure 5:
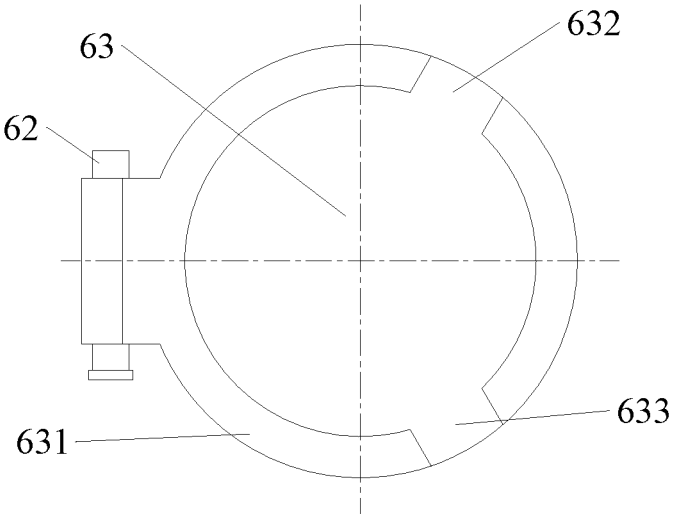
FIG. 5 is a schematic diagram of the valve structure in an embodiment.

As shown in FIG. 5, in one embodiment, an axial convex platform 631, a radial convex platform A 632 and a radial convex platform B 633 are on or included in the valve 63. There are drilling teeth 45 on the side near the bottom of the valve 63. The shape and size of the axial convex platform 631 is compatible with the shape and size of grooves 444 in the drill tool holder 44, so that the drill tool holder 44 can transfer the axial force to the valve 63. On the other hand, the valve 63 relies on the radial convex platform A 632 and the radial convex platform B 633 to withstand circumferential forces from the drill tool holder 44. Thus, the valve 63 closes the pouring channel 61 during drilling, while the valve 63 can withstand loads from the drill tool holder 44.

Figure 6:
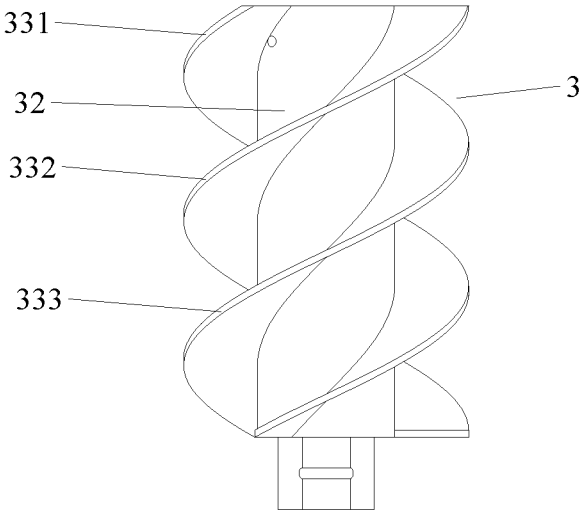
FIG. 6 is a schematic diagram of the circulation device in another embodiment.

As shown in FIG. 6, in another embodiment, the spiral piece 33 includes a spiral A 331, a spiral B 332 and a spiral C 333, which are independent, symmetrically arranged and have the same pitch. In this embodiment, the spiral A 331 or the spiral B 332 or the spiral piece C 333 can be set as a whole, but the spiral piece 33 of equal section size can be set as multiple pieces. In this setting mode, the cost of the spiral piece 33 increases relatively, but the structural strength of the circulating device 3 increases, and the ability of circulating cuttings discharge increases appropriately.

Both of the above two embodiments can achieve the purpose of efficient cuttings discharge invention, and technicians in this field can choose according to the actual situation.

In order to facilitate the continuous and rapid removal of cuttings during drilling, the preferred scheme is as follows: when the spiral piece 33 is effectively connected with the transmission parts 43, the number and the pitch of the spiral piece 33 and the transmission parts 43 are the same. For example, when the circulation connection 35 is connected with the connecting sleeve B 42, smooth and continuous connection is made between the spiral piece 33 and the transmission parts 43 to achieve continuous and rapid cuttings removal.

In the above implementation mode, the power connector 2, the circulation device 3, the drill assembly, the cleaning mechanism and the pouring mechanism are used to achieve the purpose of the higher efficiency, more reliable circulation and simple operation.

In this implementation mode, torque and bit pressure are transmitted through the power connector 2 and the circulation device 3 to drive the drill assembly to screw forward and achieve synchronous cuttings removal through the circulation device 3. Drilling to the geological layer meeting the requirements, the external control pushes the cleaning blade 51 to extend through the linkage 52 to implement the cuttings removal at the bottom of the well.

After the completion of the bottom hole cleaning operation, there is no need to replace the pouring equipment to achieve efficient continuous pouring operation. The rock is broken by crushing or cutting for the drilling teeth 45 under the axial pressure and circumferential force when drilling is normally. The cuttings are discharged from the inside out; and cuttings discharged to the periphery can be brought out from the bottom of the well by means of the mutual extrusion between cuttings, which are successively brought out from the bottom by means of the transmission parts 43 and the spiral piece 33. When drilling into the geological layer meeting the requirements, the external control pushes the cleaning blade 51 to extend by stretching the control parts 53, and there is no need to generate large axial pressure at this time. Similarly, the cuttings are removed by the mutual extrusion effect between cuttings.

After the completion of cuttings removal at the bottom of the well, it needs to stop drilling and lift properly drill assembly to the a certain height from the bottom of the well; and then the concrete flows through the pouring channel 61, which pushes the valve 63 with its own energy, and finally flows to the bottom of the well. The invention achieves the efficient drilling, synchronous cuttings discharge and continuous concrete pouring.

The integrated piling tool provided by the invention can be used in sites with complex geological conditions. In one embodiment, the integrated piling tool with continuous drilling and circulation pouring is a building piling driver which can achieve high-efficiency drilling, synchronous cuttings discharge and continuous pouring, and the drilling efficiency in piling is improved through the structural design of the drill assembly. The circulator structure is designed so that the drilling process is synchronized with the cuttings discharge. After the piling is completed, the existing piling tools are used to pour the concrete efficiently. This setting method is simple in structure and completely depends on mechanical structures, without the need for electrical structures that are prone to failure in the complex and changeable underground environment. It can achieve higher efficiency, more reliable circulation and simple operation.

The above content is merely an example to describe the structure of the present invention. Technical personnel in the technical field can make various modifications or additions to the specific embodiments described or use similar methods to replace them, as long as such modifications or additions do not deviate from the structure of the invention or go beyond the present invention, they shall all fall into the protection scope of the present invention defined by the claims of the invention.

What is claimed is:

1. An integrated piling tool with continuous drilling and circulation pouring, comprising: a power connector, a circulation device, a drill assembly, a cleaning mechanism and a pouring mechanism; wherein the circulation device includes a first connecting sleeve, a drill barrel, a spiral piece, a spiral reinforcement, a circulation connection, a first semicircular connecting groove, and a fixing orifice; the first connecting sleeve is connected to the power connector and the circulation connection is connected to the drill assembly; the spiral piece continuously transports cuttings during piling drilling; and the drill assembly includes a drill body, a second connecting sleeve, transmission parts, a drill tool holder, drilling teeth, fixing pieces, and a second semicircle connecting groove; the drilling teeth are detachable from the drill tool holder and are configured to cut and burst rock; the transmission parts deliver the cuttings from inside the drill assembly to outside the circulation device and from below the drill assembly to the spiral piece; the pouring mechanism comprises a pouring channel, a pin, and a valve; and the circulation device, the pouring channel and the valve are configured to implement concrete pouring.

2. The integrated piling tool with continuous drilling and circulation pouring as in claim 1, wherein: the power connector comprises a polygonal connection and a first semicircular groove; the first connecting sleeve is connected to the polygonal connection; the first semicircular groove and the fixing orifice form a first circular fixing hole; the integrated piling tool further comprises a first fixing pin that fixes the circulation device to the power connector; the circulation connection is in contact with the second connecting sleeve; the first semicircle connecting groove and the second semicircle connecting groove form a second circular fixing hole, and the integrated piling tool further comprises a second fixing pin that fixes the circulation device to the drill assembly; and the spiral reinforcement is on the drill barrel and either inside or outside the circulation device.

3. The integrated piling tool with continuous drilling and circulation pouring as in claim 2, further comprising a power input shaft, wherein: the power connector further includes a polygonal sleeve and a semicircular fixing hole; the polygonal sleeve and the power input shaft have a clearance fit therebetween; the semicircular fixing hole is symmetrical around the polygonal sleeve; the power connector and the power input shaft are fixed in the axial direction by a third fixing pin that matches with the first circular fixing hole, and the polygonal connection is connected to the first connecting sleeve.

4. The integrated piling tool with continuous drilling and circulation pouring as in claim 1, wherein: the drill tool holder includes a circular outer ring, an inner ring that is coaxial with the outer ring, and a blade between the inner ring and the outer ring; the drilling teeth are on an end face of the drill tool holder, and the drill tool holder is connected with the drill body.

5. The integrated piling tool with continuous drilling and circulation pouring as in claim 3, wherein: the valve has a circumference that matches with the inner ring; and the valve is connected to the fixing pieces by the pin.

6. The integrated piling tool with continuous drilling and circulation pouring as in claim 1, wherein: an angle $\alpha$ between an axis of each of the drilling teeth and a horizontal plane of the drill tool holder is between 60° and 85°.

7. The integrated piling tool with continuous drilling and circulation pouring as in claim 1, wherein: the transmission parts include a first transmission spiral blade, a second transmission spiral blade and a third transmission spiral blade, uniformly arranged on a plane of the drill tool holder.

8. The integrated piling tool with continuous drilling and circulation pouring as in claim 1, wherein: the power connector comprises a first inner channel, the drill barrel comprises a second inner channel, and the drill body comprises a third inner channel; and the pouring channel successively comprises the first inner channel, the second inner channel, and the third inner channel.

9. The integrated piling tool with continuous drilling and circulation pouring as in claim 1, further comprising a cleaning mechanism that includes a cleaning blade, a linkage, control parts and fixing pieces; the cleaning blade is hinged with the fixing pieces by a fourth fixing pin, and the control parts are configured to extend the cleaning blade.

* * * * *